US010004934B2

(12) United States Patent
Pennington

(10) Patent No.: US 10,004,934 B2
(45) Date of Patent: Jun. 26, 2018

(54) REVERSE DEADLIFT APPARATUS

(71) Applicant: Michael J. Pennington, Chula Vista, CA (US)

(72) Inventor: Michael J. Pennington, Chula Vista, CA (US)

( * ) Notice: Subject to any disclaimer, the term of this patent is extended or adjusted under 35 U.S.C. 154(b) by 0 days. days.

(21) Appl. No.: 15/191,521

(22) Filed: Jun. 23, 2016

(65) Prior Publication Data

US 2017/0368403 A1 Dec. 28, 2017

Related U.S. Application Data

(60) Provisional application No. 62/183,596, filed on Jun. 23, 2015.

(51) Int. Cl.

| | |
|---|---|
| ***A63B 21/06*** | (2006.01) |
| ***A63B 21/072*** | (2006.01) |
| ***A63B 21/062*** | (2006.01) |
| ***A63B 21/075*** | (2006.01) |
| ***A63B 21/00*** | (2006.01) |
| ***A63B 23/02*** | (2006.01) |
| ***A63B 23/04*** | (2006.01) |

(52) U.S. Cl.

CPC ..... *A63B 21/0724* (2013.01); *A63B 21/063* (2015.10); *A63B 21/075* (2013.01); *A63B 21/154* (2013.01); *A63B 21/4034* (2015.10); *A63B 23/0233* (2013.01); *A63B 23/04* (2013.01)

(58) Field of Classification Search

CPC ..... A63B 21/4035

See application file for complete search history.

(56) References Cited

U.S. PATENT DOCUMENTS 4,598,908 A * 7/1986 Morgan ..... A63B 21/0724 482/104

7,250,022 B2 * 7/2007 Dalebout ..... A63B 21/045 482/121

* cited by examiner

*Primary Examiner* — Gregory Winter
*Assistant Examiner* — Rae Fischer
(74) *Attorney, Agent, or Firm* — Michael J. Pennington

(57) ABSTRACT

The embodiments herein relate to an exercise machine for training the muscles of the whole body while specifically targeting the muscles of the legs and back. Specifically, the embodiments herein relate to a Reverse Deadlift Apparatus which allows a trainee to mimic a barbell type deadlift exercise in a safer and more productive fashion. An additional benefit is that the Reverse Deadlift Apparatus encourages a lifter to use proper technique by requiring them to use more of their legs and less of their lower back during the lift. The result of using the Reverse Deadlift Apparatus on a regular basis is that a lifter will increase the strength and power of the muscles of the whole body and specifically will make improvements in the lower body. The added strength and power, along with optimized Deadlifting form, will help a lifter improve their performance in the actual barbell deadlift itself and in any sports requiring a strength or power component (e.g. Football, Baseball, Martial Arts, Wrestling, Powerlifting, Olympic Lifting, Tennis, etc.).

3 Claims, 2 Drawing Sheets

REVERSE DEADLIFT APPARATUS

TECHNICAL FIELD

The embodiments herein relate to the field of exercise equipment and, more particularly, to a reverse deadlift apparatus.

BACKGROUND

Exercise and fitness is currently experiencing unprecedented growth in both the US and many countries throughout the world. Those involved in fitness typically exercise using free weights (e.g. barbells and dumbbells) or resistance type machines. The resistance is typically provided in the form of free weights, selectorized cable based weights, weighted leverage type systems, elastic bands, or the like.

Many of those who train with exercise machines desire to become stronger and increase muscle size and/or tone for overall fitness and health, fitness competitions, and both professional and non-professional sports.

Many trainees exercise in a manner that targets the large muscle groups of the body such as the legs and back. One such well known exercise is the Deadlift. The deadlift is considered a basic exercise by many and is also one of the 3 competitive lifts in the sport of Powerlifting. The deadlift has recently become one of the most popular lifts due to the recent growth of both Powerlifting and Cross-Fitness type training.

The deadlift is typically done with a barbell with weights loaded on the ends of the bar, although machines do exist that mimic a typical barbell deadlift. The lift begins with the loaded bar resting on the ground in front of the trainee (hereinafter the lifter). The lifter stands in a squatting position in front of the bar (machines may have either a bar or handles), reaches down to grab the bar, and then holding the bar with both hands at arms length, stands up until they reach an erect position. The movement is then reversed and the lifter lowers the bar until it is again touching the ground in front of the lifter. This movement is repeated for the desired number of repetitions in a group of repetitions known as a set. In order to get the most out of the exercise and make the exercise as safe as possible, a lifter needs to use good form which requires using the legs and the lower back at appropriate times during the performance of the lift. Unfortunately, many lifters limit the usefulness of the deadlift, limit the amount of weight they can lift, or make the lift dangerous by not using proper form. Specifically, many lifters do not use their legs properly at the start of the lift and during the lift, thereby greatly increasing the load on the lower back, reducing the effectiveness of the lift, and greatly increasing the chance of injury. What is needed is a deadlift type machine that is designed in such a manner as to require a lifter to correctly perform the exercise by forcing them to use their legs more than their lower back throughout the movement.

The above information is presented as background information only to help the reader to understand the present invention. Applicants have made no determination and make no assertion as to whether any of the above might be applicable as Prior Art with regard to the present application.

SUMMARY OF THE INVENTION

The embodiments herein describe a Reverse Deadlift Apparatus. The Reverse Deadlift Apparatus is an exercise machine that allows a lifter to perform a lift that very closely resembles a free-weight Deadlift exercise. One of the advantages of the Reverse Deadlift Apparatus is that it encourages a lifter to use correct Deadlift form and puts a larger emphasis on the leg muscles and hips, rather than on the lower back muscles which typically occurs on a free-weight Deadlift or Deadlift machine when a lifter uses poor form and incorrectly uses too much of their lower back muscles. By allowing a lifter to perform a Deadlift using correct form, the lifter is able to learn to lift more weight in a safer manner, thereby allowing the lifter greater increases in muscle mass and strength which can be applied to many sports and physical activities.

The lifter begins by selecting an appropriate weight from the selectorized weight stack (e.g. inserting a pin into a hole thereby engaging the pin into a bar attached to the end of the cable and causing the appropriate number of desired weights to be connected to the cable). Next, the lifter steps on the foot platform. The lifter then gets into a standard deadlift position by placing their feet as desired, squatting down, and grabbing the pulling member. It should be noted that the platform is wide enough to allow a lifter to choose either of the the two common deadlifting styles often seen used in free weight barbell deadlifting; conventional or sumo. In a conventional style deadlift, the lifter typically stands with a narrow or medium stance and grabs the barbell outside of their legs. In a sumo style deadlift, the lifter typically stands with a wide stance and grabs the barbell between their legs. While using the Reverse Deadlift Apparatus, the pull member (bar, handles, or the like) may be adjusted to an appropriate level thus allowing a lifter to stand closer or farther away from the foot platform as desired. Once the pulling member is adjusted to the desired height, it becomes stationary relative to the Reverse Deadlift Apparatus Frame. The lifter attempts to pull the pulling member up with their hands while pushing their feet into the foot platform. Since the pulling member is stationary, as the lifter attempts to pull the pull member up—they cannot, and instead their legs push the foot platform down towards the ground thus lifting the attached weight. The lifter then returns to the starting position and repeats the number of desired reps thereby ending the set of the exercise.

BRIEF DESCRIPTION OF THE FIGURES

The embodiments herein will be better understood from the following detailed description with reference to the drawings, in which.

DETAILED DESCRIPTION OF EMBODIMENTS

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

The embodiments herein disclose a Reverse Deadlift Apparatus.

Figure 1:
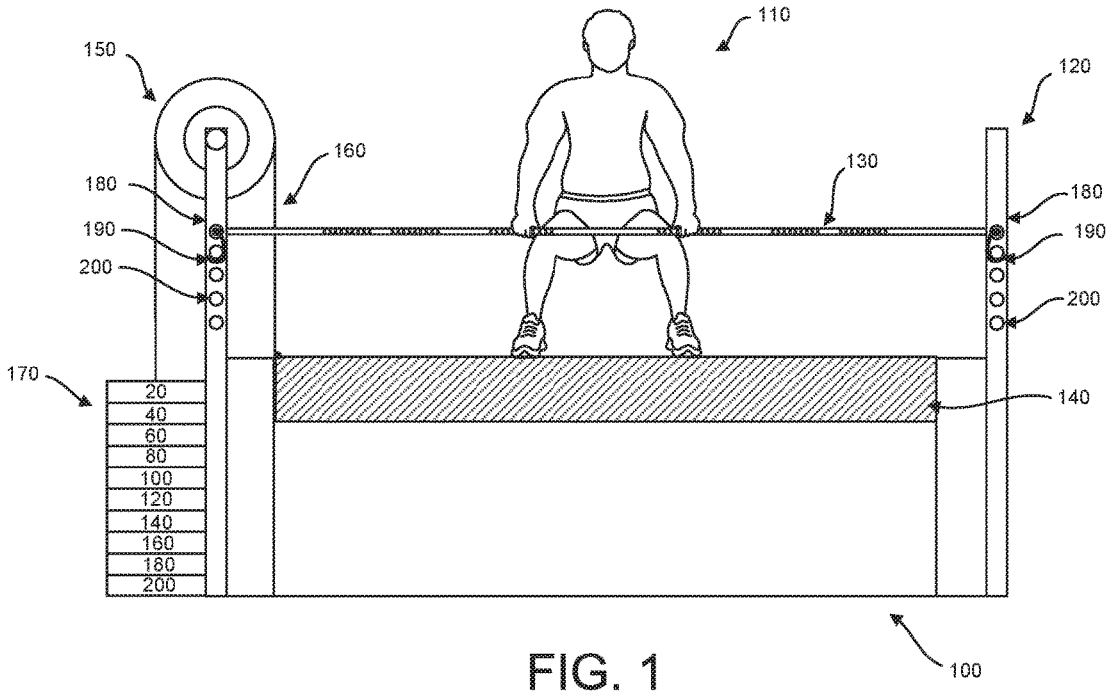
FIG. 1 illustrates a front view of one possible embodiment of the Reverse Deadlift Apparatus with the lifter in a starting position.

Referring to the drawings more particularly by reference numbers, FIG. 1 shows a Front View of one embodiment of a Reverse Deadlift Apparatus. The Reverse Deadlift Apparatus 100 includes a frame 120 which may be constructed of a sturdy, rigid material, such as metal. Attached to the frame is a pull member 130 which is attached horizontally to both sides of the vertical members of the frame 120. The pull member may be constructed of a sturdy, rigid material, such as metal. A lifter 110 is shown grabbing the pull member 130 and standing on the foot platform 140. The foot platform 140 moves up and down vertically relative to the frame 120. Pull member 130 may move up and down vertically relative to the frame using slides 180 or any other mechanism which is well known in the art and which allows up and down movement of the pull member 130. A pulley 150 is attached to one side of the frame 120 on one of its vertical members (those skilled in the art would quickly ascertain that a setup with 2 pulleys, 2 weight stacks, etc. could be used in an alternate embodiment, and that the pull member could comprise a continuous bar, or separate handles). Pull member 130 can be adjusted to different stationary heights relative to the frame 120, by rotating the pull member 130 up which disconnects hooks 190 on the ends of the pull member 130 to disengage pins 200, raising or lowering the pull member 130 to the desired height, and then rotating the pull member 130 down until the hooks engage the desired pins 200. (Those skilled in the art will quickly ascertain the other well known means for allowing the pull member to be adjusted to different heights). A cable 160 attaches to the foot platform 140, is routed over pulley 150, and is attached to a selectorized weight stack 170. While the lifter 110 is attempting to pull down on the pull member 130, a downward force is created on the foot platform causing the foot platform 140 to travel in a downward direction towards the lower portion of the frame, thereby pulling the cable 160 over the pulley 150, and resulting in the lifting of the selected amount of weight from the selectorized weight stack 170.

Figure 2:
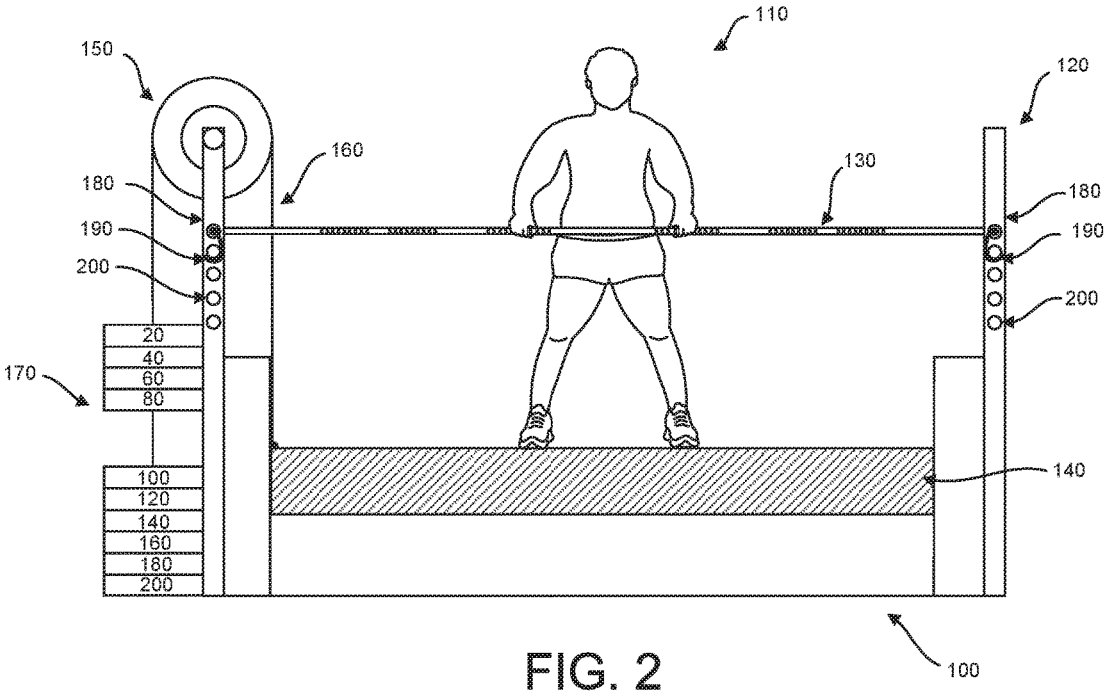
FIG. 2 illustrates a front view of one possible embodiment of the Reverse Deadlift Apparatus with the lifter in a finished position.

FIG. 2 shows the lifter 110 with hands holding pull member 130 with feet extended and pushing down on foot platform 140 which lifts up the selected weight 170 via cable 160.

What is claimed is:

1. An exercise apparatus, comprising:

a two sided substantially vertical frame;

a first weight adapted to move relative to the frame;

a second weight adapted to move relative to the frame, wherein the first weight and the second weight are on opposite sides of the frame;

a bar operatively connected to the frame, wherein the bar is positioned horizontally between the two sides of the frame;

wherein the bar is adapted to adjust to multiple selected heights, and wherein the bar is configured to be stationary once it is adjusted to a selected height;

a foot platform capable of moving up and down in a substantially vertical direction relative to the bar;

a first pulley and a second pulley attached to opposite sides of the frame;

a first cable going over the top of the first pulley; and a second cable going over the top of the second pulley, wherein the first cable is connected between the first weight and the foot platform and the second weight is connected between the second weight and the foot platform;

wherein, when a user stands on the platform, grips the bar with their hands, and exerts force on the foot platform with their legs in an opposite direction of the bar, the foot platform moves downward relative to the bar, the first weight is lifted up by the first cable, and the second weight is lifted up by the second cable.

2. The bar of claim 1, wherein the bar is smooth or knurled.

3. The exercise apparatus of claim 1, wherein the first weight or the second weight is a selectorized weight stack configured to vary the exercise resistance by inserting a pin into a hole in the stack.

* * * * *